US007810414B2

(12) United States Patent
Hsu

(10) Patent No.: US 7,810,414 B2
(45) Date of Patent: Oct. 12, 2010

(54) DEPTH ADJUSTMENT DEVICE FOR POWER TOOL

(75) Inventor: Ming-Hung Hsu, Taichung (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 3 days.

(21) Appl. No.: 12/273,338

(22) Filed: Nov. 18, 2008

(65) Prior Publication Data

US 2010/0067996 A1 Mar. 18, 2010

(30) Foreign Application Priority Data

Sep. 15, 2008 (TW) ..... 97216631 U

(51) Int. Cl.
*B25B 23/00* (2006.01)

(52) U.S. Cl. ..... 81/429; 81/54

(58) Field of Classification Search ..... 81/429, 81/54, 52, 57.42; 173/13
See application file for complete search history.

(56) References Cited

U.S. PATENT DOCUMENTS 4,030,383 A 6/1977 Wagner
4,647,260 A 3/1987 O'Hara et al.
5,341,704 A 8/1994 Klemm
6,240,816 B1 * 6/2001 Riedl et al. ..... 81/429
6,499,381 B2 * 12/2002 Ladish et al. ..... 81/429
6,912,932 B2 * 7/2005 Kriaski et al. ..... 81/54

* cited by examiner

*Primary Examiner*—Hadi Shakeri
(74) *Attorney, Agent, or Firm*—Browdy & Neimark, PLLC

(57) ABSTRACT

A depth adjustment device is mounted to a front end of a power tool, having a coupling member fixed to the front end of the power tool, a hollow stationary sleeve, and a hollow adjustment sleeve. The coupling member includes a limit recess and a lock recess at an external periphery thereof. The stationary sleeve is sleeved onto the coupling member, having two first lock portions corresponding to the limit recess, a springy part formed at a rear end thereof, and a second lock portion formed at a distal end of the springy part. The first lock portions are stopped against the lock recess. The second lock portion is locked to the lock recess. The adjustment sleeve includes a lip portion at a front end thereof for lying against a surface of a workpiece and is threadably connected with the stationary sleeve to be movably mounted to the stationary sleeve.

2 Claims, 9 Drawing Sheets

DEPTH ADJUSTMENT DEVICE FOR POWER TOOL

BACKGROUND OF THE INVENTION

1. Field of the Invention

The present invention relates generally to power tools, and more particularly, to a quick-release depth adjustment device for a power tool.

2. Description of the Related Art

A general power tool is powered by an electric motor or pneumatic turbo for rotary output to drive rotation of a drive bit or drill bit. As far as the drive bit is concerned, the drive bit is usually connected with a power source by a clutch in such a way that the user must hold the power tool and apply a positive force to the drive bit to enable the drive bit to be coupled with the power source and then to be driven by the power source for rotation.

When the drive bit screws a screw onto a workpiece, the screw must be stopped from rotation driven by the drive bit after contact with the surface of the workpiece or while the screw is screwed tight to enable allowable recession formed on the surface of the workpiece. Otherwise, if the drive bit keeps rotation, the screw head may be damaged or the screw may damage the workpiece, stripping the screw. However, the user operating the power tool having incessant power output often fails to stop operation of the power tool immediately at the right time and the maximum torsion of the clutch is often great enough to damage the screw or the workpiece.

To solve the aforementioned problem, a variety of conventional depth adjustment devices for power tools were proposed to stop the drive bit from moving further after the screw is screwed to a predetermined depth of the workpiece and to interrupt the transmission coupling between the drive bit and the power tool to prevent the drive bit from tightening the screw. For example, each of U.S. Pat. Nos. 4,030,383, 4,647,260, and 5,341,704 similarly discloses that a length-adjustable sleeve is fixed to a front end of the power tool having a clutch for the drive bit to run through and the drive bit is exposed outside for a predetermined length mating the depth where the screw is screwed into the workpiece. When the screw is screwed into the workpiece for a predetermined depth, a front end of the sleeve contacts the surface of the workpiece to disable the user from keeping applying the positive force to the drive bit via the power tool to interrupt the power coupling of the clutch. In this way, the power tool stops driving rotation of the drive bit to prevent the screw from threadably moving further while the screw is screwed to the predetermined depth, thus preventing the screw from being damaged by the drive bit or from damaging the workpiece.

Although the aforesaid conventional depth adjustment devices provide the function of depth adjustment, the way that each of those devices is connected with the power tool is disadvantageous to assembly and disassembly of the depth adjustment device. For example, each of the depth adjustment devices of the U.S. Pat. Nos. 4,030,383 and 4,647,260 is mounted to the front end of the power tool by screw thread fit, such that the assembly and disassembly of the depth adjustment device are not convenient. Particularly, the power tool itself often needs to mate with different apparatuses for operation, such that the aforesaid device mounted to the front end of the power tool must be replaced frequently. For example, an automatic screw feeding device instead of the depth adjustment device is provided for supplying screws quickly and uninterruptedly. However, in the automatic screw feeding device, the screw feeding track must be fixed to a specific location, such that the screw thread fit is not applicable to the connection between the automatic screw feeding device and the power tool. In this way, the power tool can only be installed with one of the devices. The depth adjustment device of the U.S. Pat. No. 5,341,704 is mounted to the power tool by that its annular rib formed inside the sleeve is engaged with the annular grove formed at the front end of the power tool. Such design is subject to wear and tear of the annular rib/groove during the assembly and the disassembly and thus disadvantageous to repeated assembly and disassembly.

SUMMARY OF THE INVENTION

The primary objective of the present invention is to provide a depth adjustment device, which can be installed to or detached from a power tool quickly without the assistance of any tool.

The foregoing objective of the present invention is attained by the depth adjustment device mounted to a front end of a power tool. The power tool includes a drive bit mounted to the front end thereof and driven for rotation thereby via a clutch. The drive bit protrudes out of the depth adjustment device to screw a screw onto a workpiece. The depth adjustment device is composed of a coupling member, a stationary sleeve, and an adjustment sleeve. The coupling member includes a through hole and is fixed to the front end of the power tool. The drive bit of the power tool passes through the through hole of the coupling member. The coupling member further includes a limit recess and a lock recess at each of two opposite positions of an external periphery thereof. Each of the limit recesses extends along an imaginary longitudinal axis of the coupling member. Each of the lock recesses crosses the limit recess and extends from an end of the limit recess. The stationary sleeve is hollow inside and sleeved onto the coupling member for the drive bit to pass therethrough. The stationary sleeve includes two first lock portions formed at at least one position of one side thereof and corresponding to the respective limit recesses, two springy parts formed at a rear end thereof, and two second lock portions each formed at a distal end of one of the springy parts. Each of the first lock portions is stopped against one of two lateral sidewalls of the lock recess. The second lock portions are locked to the respective lock recesses. The stationary sleeve further includes an external thread formed at an external periphery thereof. The adjustment sleeve is hollow inside, having a lip portion at a front end thereof for lying against a surface of a workpiece. The drive bit passes through the adjustment sleeve and protrudes beyond a front end of the adjustment sleeve. The adjustment sleeve further includes an internal thread formed therein and engaged with the external thread of the stationary sleeve, whereby the adjustment sleeve can be movably mounted to the stationary sleeve, and the depth for which the screw is screwed onto the workpiece is adjusted as the length for which the drive bit protrudes beyond the lip portion is changed. When the drive bit screws the screw for a predetermined depth, the lip portion is stopped against the surface of the workpiece to stop the drive bit from taking any positive force and to interrupt the power coupling of the clutch. In addition, the coupling member can be alternatively connected with another auxiliary device, like automatic screw feeding device.

DETAILED DESCRIPTION OF PREFERRED EMBODIMENTS

Figure 1:
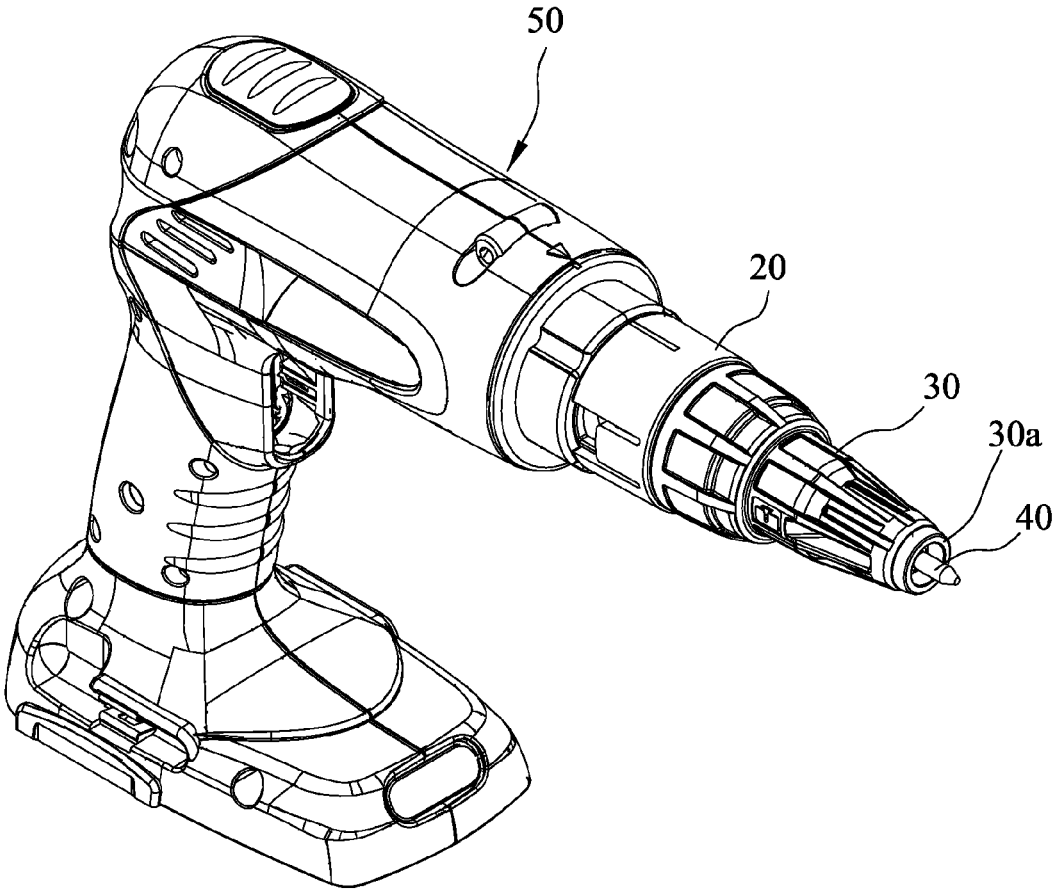
FIG. 1 is a perspective view of a preferred embodiment of the present invention connected with a power tool.
Figure 2:
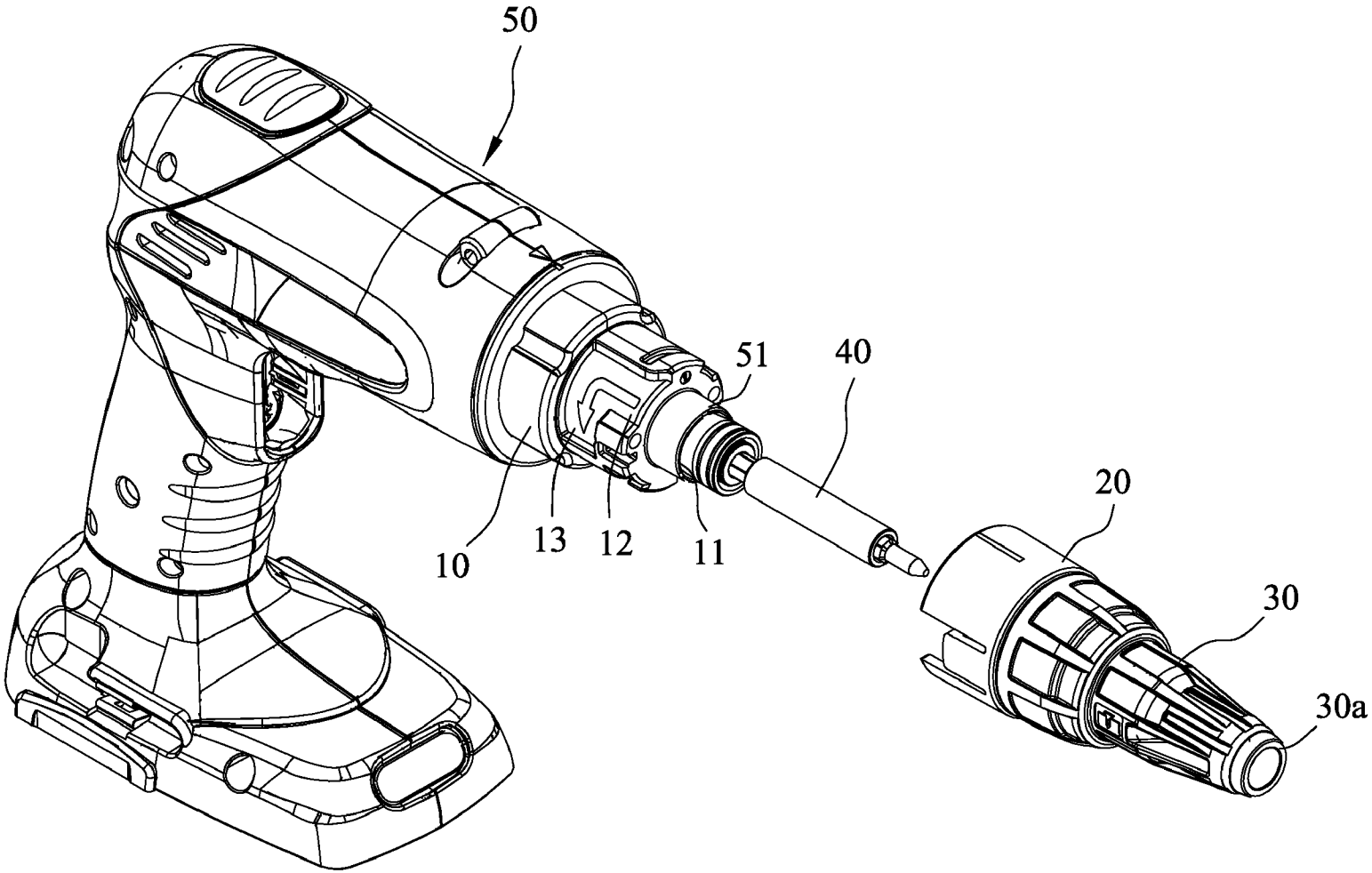
FIG. 2 is a perspective view of the preferred embodiment of the present invention partially separated from the power tool.

Referring to FIGS. 1-2, a depth adjustment device constructed according to a preferred embodiment of the present invention is installed to a front end of a power tool 50 having a drive bit 40 and is fitted onto the drive bit 40. When a length for which the drive bit 40 protrudes or shrinks with respect to the depth adjustment device is adjusted, a depth for which a screw screwed onto a workpiece is changed.

Figure 3:
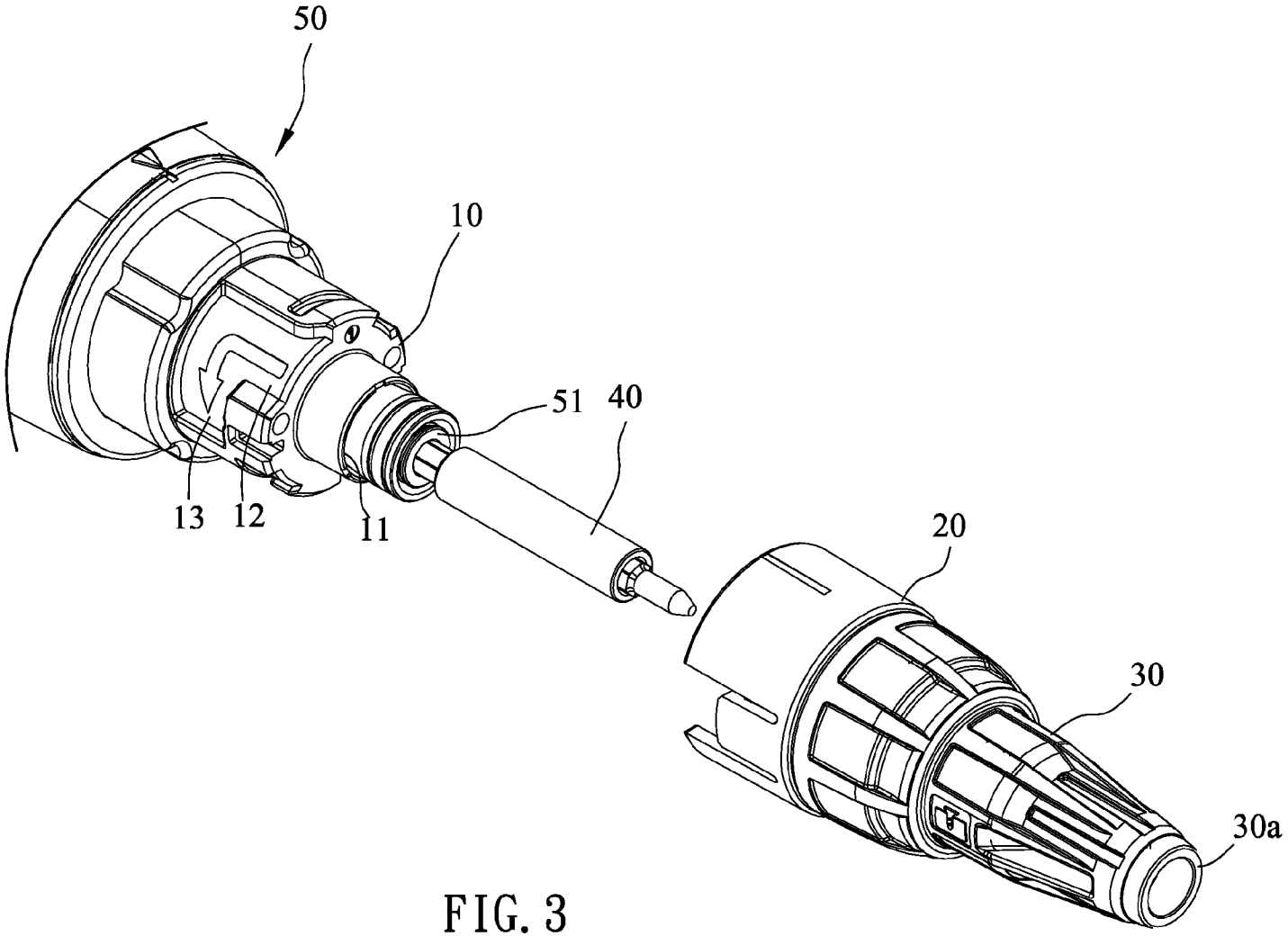
FIG. 3 is an enlarged view of a part of FIG. 2.
Figure 4:
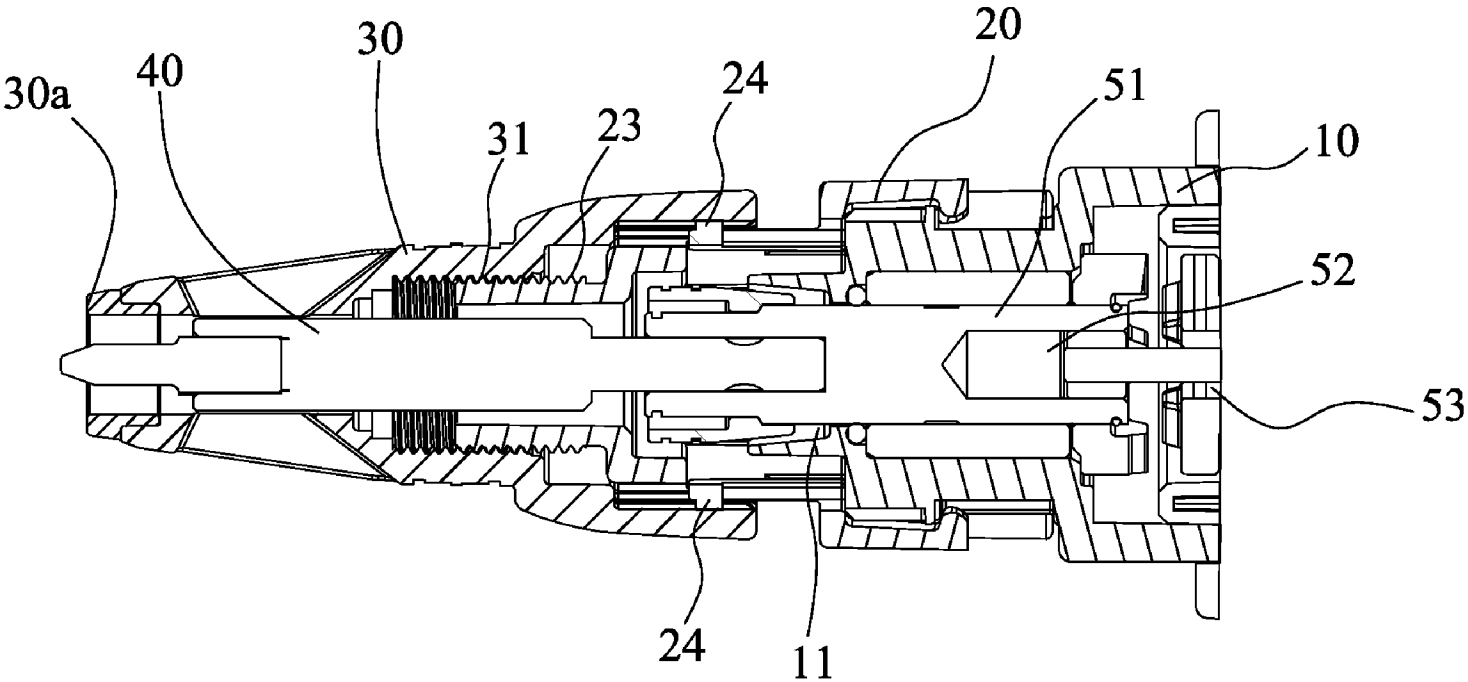
FIG. 4 is a sectional view of the preferred embodiment of the present invention connected with the power tool.

Referring to FIGS. 2-4, a tool chuck 51 is mounted to the front end of the power tool 50 for holding the drive bit 40. The tool chuck 51 is connected with a power source 53 of the power tool 50 via a clutch 52 to enable the drive bit 40 to be connected with the power tool 50 via the clutch 52 and to be driven by the power tool 50 for rotation. When a positive force toward the power tool 50 is applied to the drive bit 40, the tool chuck 51 can be pushed toward the power source 53 to activate the coupling status of the clutch 52 and to enable the drive bit 40 and the tool chuck 51 to be coupled with the power source 53 via the clutch 52 and then to be driven for rotation. The power source can be but not limited to an electric motor or a pneumatic turbo.

Figure 5:
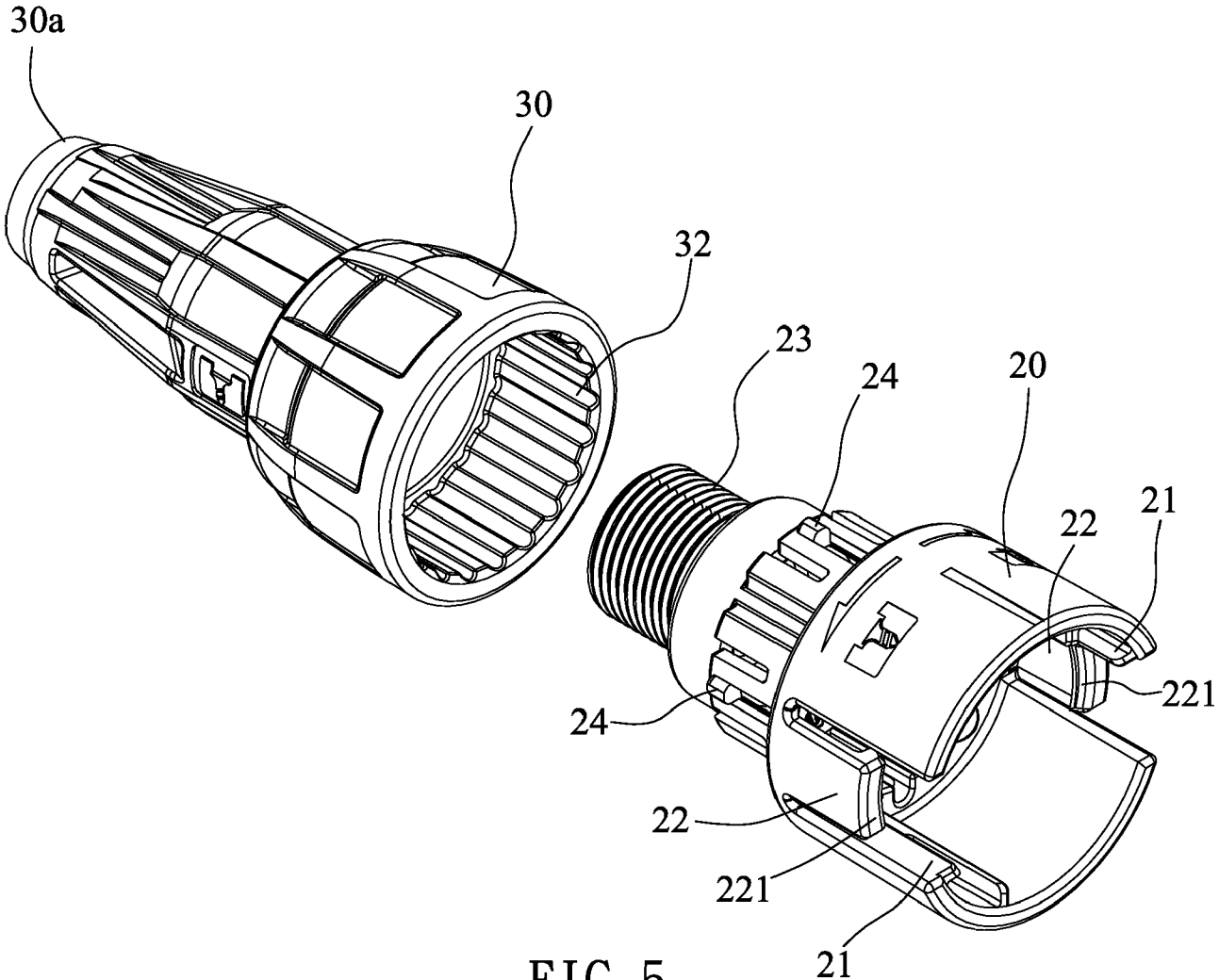
FIG. 5 is an exploded view of a part of the preferred embodiment of the present invention.

Referring to FIGS. 3-5, the depth adjustment device includes a coupling member 10, a stationary sleeve 20, and an adjustment sleeve 30. The coupling member 10 has a through hole 11, fixed to the front end of the power tool 50 and sleeved onto the tool chuck 51, whereby the tool chuck 51 and the drive bit 40 pass through the through hole 11. The coupling member 10 has a limit recess 12 and a lock recess 13 at each of two opposite positions of an external periphery thereof. Each of the limit recesses 12 extends along an imaginary longitudinal axis of the coupling member 10. Each of the limit recesses 12 has an open end located at a front end of the coupling member 10. Each of the lock recesses 13 crosses the limit recess 12 and extends along the external periphery of the coupling member 10 from the other end of the limit recess 12.

Figure 6:
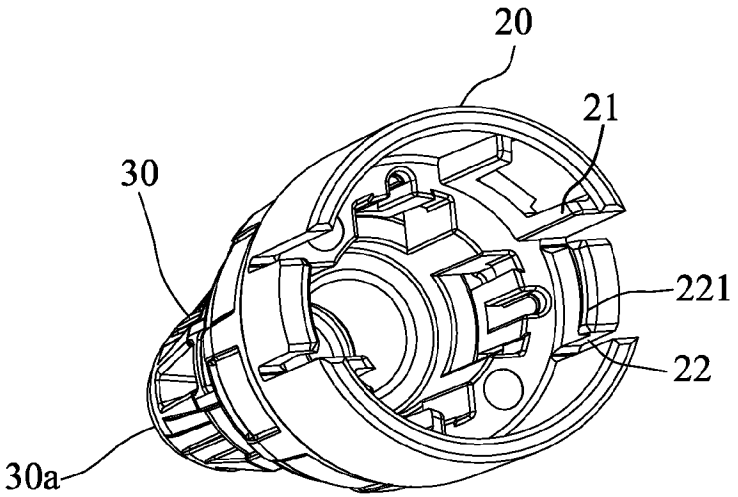
FIG. 6 is a perspective view of a part of the preferred embodiment of the present invention.
Figure 8:
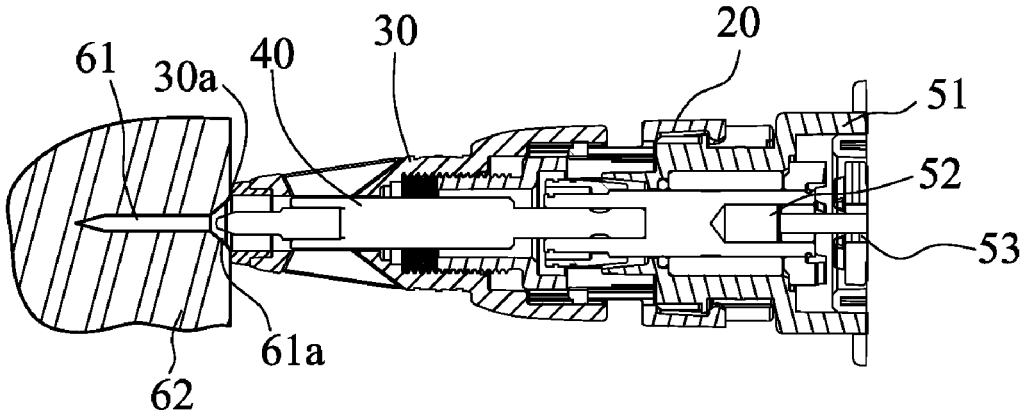
FIGS. 8-12 illustrate the operation of the power tool connected with the present invention.
Figure 9:
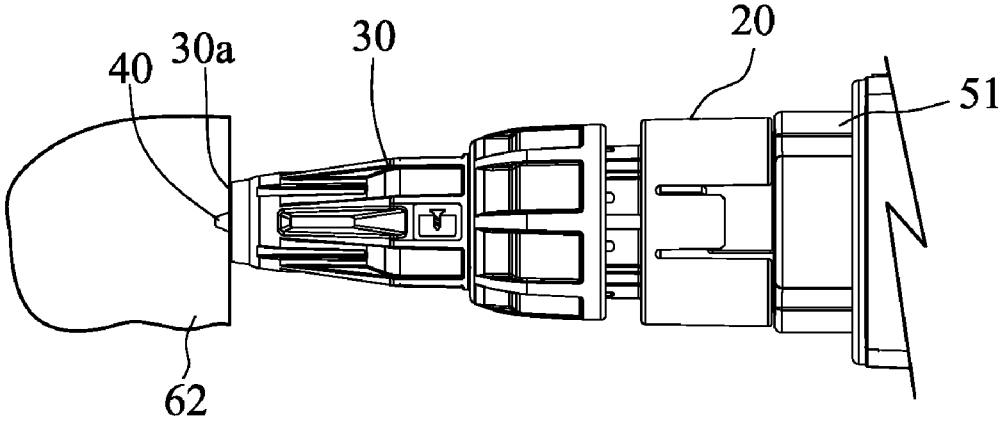
Figure 10:
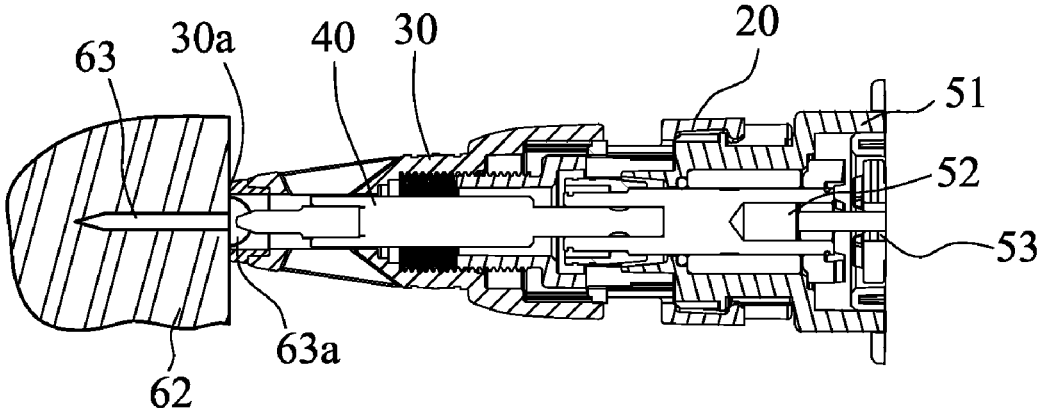

Referring to FIG. 6 in view of FIG. 3 again, the stationary sleeve 20 is annularly stepped and hollow inside to be sleeved onto the coupling member 10 for the drive bit 40 to pass therethrough. The profile of an internal rear part of the stationary sleeve 20 matches that of the coupling member 10. The stationary sleeve 20 has two first lock portions 21, each of which is formed at one of two opposite positions of an underside thereof and close to a rear opening thereof. The first lock portions 21 are adapted for lying against respective sidewalls of the lock portions 13 to stop the stationary sleeve 20 from rotation with respect to the coupling member 10. The stationary sleeve 10 further has two springy parts 22 formed at a rear end thereof. Each of the springy parts 22 has a second lock portions 221 formed at a distal end thereof. The two second lock portions 221 can be locked at the respective lock recesses 13 to enable the stationary sleeve 20 to be fixed to the coupling member 10 and to prevent the stationary sleeve 20 from disengagement from the stationary sleeve 20. The stationary sleeve 20 is cylindrical at a front part thereof, having an external thread 23 formed at an external periphery thereof of the cylindrical part thereof. The stationary sleeve 20 further includes a plurality of protrusive positioning clink pieces 24 formed at a midsection of an external periphery of the stationary sleeve 20.

Figure 7:
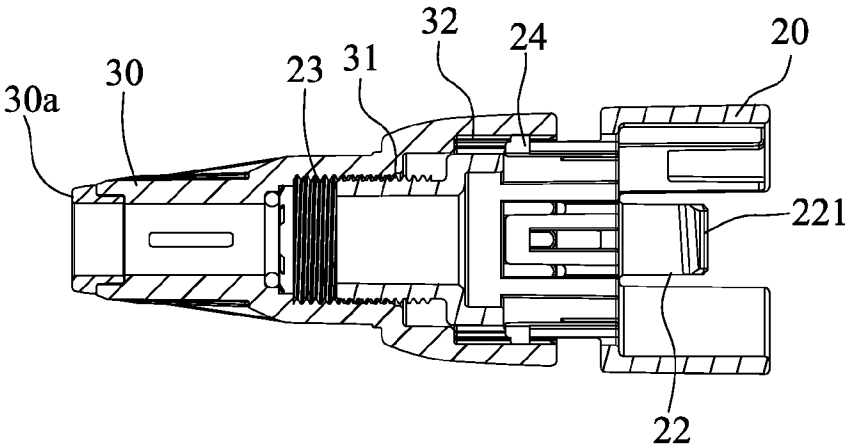
FIG. 7 is a sectional view of a part of the preferred embodiment of the present invention.

Referring to FIGS. 5-7, the adjustment sleeve 30 is hollow inside and its internal profile matches the external profile of the stationary sleeve 20 to enable the adjustment sleeve 30 to be sleeved onto the stationary sleeve 20. The adjustment sleeve 30 includes a lip portion 30*a* formed at a front end thereof. After the adjustment sleeve 30 is sleeved onto the stationary sleeve 20, a front end of the drive bit 40 can protrude beyond the lip portion 30*a*. The adjustment sleeve 30 includes an internal thread 31 formed therein and engaged with the external thread 23 of the stationary sleeve 20 to movably mount the adjustment sleeve 30 onto the stationary sleeve 20.

Referring to FIG. 7 again, when the adjustment sleeve 30 is rotated with respect to the stationary sleeve 20, the adjustment sleeve 30 moves forward or backward along an imaginary longitudinal axis of the stationary sleeve 20.

As shown in FIGS. 5-7, the adjustment sleeve 30 includes a plurality of positioning dents 32 arranged parallel at an internal side thereof and corresponding to the positioning clink pieces 24 respectively. When the adjustment sleeve 30 is sleeved onto the stationary sleeve 20, each of the positioning clink pieces 24 is stopped against one of the positioning dents 32 to stop the adjustment sleeve 30 from rotation with respect to the stationary sleeve 20, thus preventing the adjustment sleeve 30 from rotation and moving forward or backward along the imaginary longitudinal axis of the stationary sleeve 20 due to impinge or shock incurred by an external force. When the user turns the adjustment sleeve, the positioning clink pieces 24 are forced to move across the positioning dents 32 to utter clinks, such that a multi-stage adjustment mode is provided. The user can hear the number of clinks to identify the rotational angle and the feed rate of the adjustment sleeve 30 with respect to the stationary sleeve 20.

Referring to FIGS. 8-12, the stationary sleeve 20 and the drive bit 40 are stationary, such that when the adjustment sleeve 30 is moved straight forward or backward, the depth for which the drive bit 40 protrudes out of or shrinks into the adjustment sleeve 30 is changed. The depth for the drive 40 is subject to the depth, for which the screw 61 or 63 is screwed, and usually equal to the depth of the screw 61*a* or the height of the screw 63*a* with respect to the surface of the workpiece 62.

Referring to FIGS. 1-2 & 5 again, the stationary sleeve 20 and the adjustment sleeve 30 are detachably mounted to the front end of the power tool 50 by that the first and second lock portions 21 and 221 are locked to the limit and lock recesses 12 and 13.

While installing the depth adjustment device, the user can move the stationary sleeve 20 toward the front end of the power tool 50 to sleeve the stationary sleeve 20 onto the coupling member 10, enabling each of the first lock portions 21 to be stopped against two lateral sidewalls of the limit recess 12 and enabling the second lock portions 221 to be locked to the lock recess 13, and finally the depth adjustment device is mounted to the power tool 50. While detaching the depth adjustment device from the power tool 50, the user can apply a force to the stationary sleeve 20 to force the second lock portions 221 to disengage from the lock recesses 13 and then to remove the coupling member 10 from the stationary sleeve 20. When an auxiliary device, like automatic screw feeding device, is to be installed to the power tool 50, the auxiliary device can have the similar lock portions corresponding to the respective lock recesses 13 and then be connected with the coupling member 10 via the lock portions locked to the respective lock recesses 13 to be fixed to the front end of the power tool 50, further fastening the relative orientation between the auxiliary device and the power tool 50.

As mentioned above, the length what the drive bit 40 protrudes or shrinks is dependent on the depth what the screw is screwed and is equal to the depth or height of the screw with respect to the workpiece. Referring to FIGS. 8 and 9 again, when a flat-head screw 61 is directly screwed onto the surface of the a workpiece 62, the screw is screwed onto the workpiece for such a depth that a screw head 61*a* of the screw 61 can remain on the surface of the workpiece 62 or the screw head 61*a* can slightly squeeze and recess the surface of the workpiece 62. In this way, what the drive bit 40 needs to protrude is its head in such a way that the head of the drive bit 40 can be stopped against a concavity of the screw head 61*a*. When the user operates the power tool 50 to screw the screw 61, the power tool 50 applies a positive force to the drive bit 40 to force the head of the drive bit 40 to be stopped against the screw head 61*a* and meanwhile to enable the transmission coupling of the clutch 52, such that the power source 53 can drive the drive bit 40 to rotate. When the screw 61 is screwed to a predetermined depth, i.e. the screw head 61*a* is threadably connected with the surface of the workpiece 62, the lip portion 30*a* of the adjustment sleeve 30 is stopped against the surface of the workpiece 62 to stop the drive bit 40 from moving further and to stop the user from applying any positive force to the drive bit 40. In the meantime, the clutch 52 stop the transmission coupling to stop the drive bit 40 from rotation to avoid damage to the screw 61 or the workpiece 62.

Referring to FIG. 10 again, when a round-head screw 63 is directly screwed onto the surface of the workpiece 62, the drive bit 40 must shrink into the adjustment sleeve 30 to enable its head to be stopped against the screw head 63*a* of the screw 63.

Figure 11:
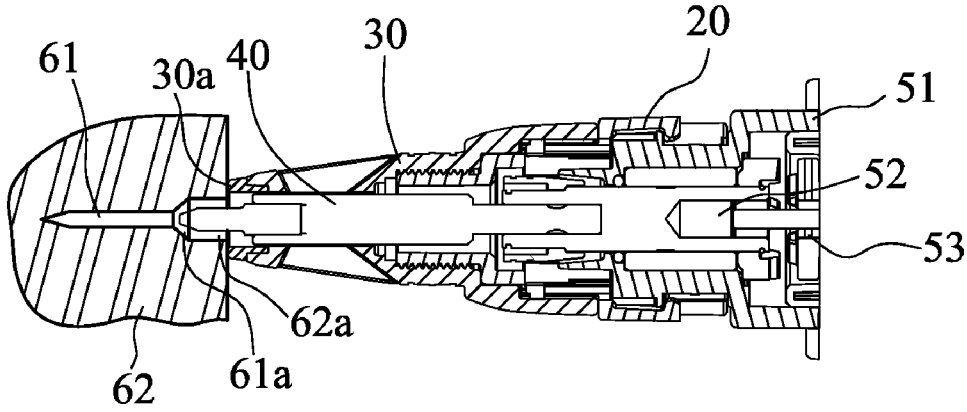
Figure 12:
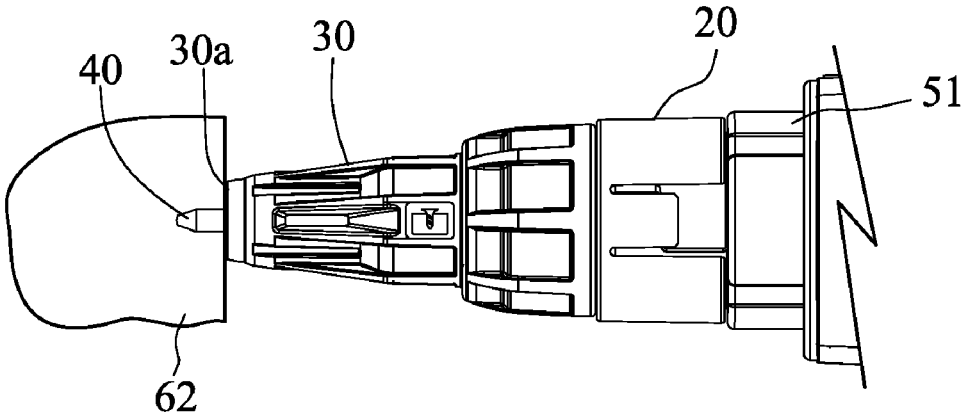

Referring to FIGS. 11 and 12, when the screw 61 is screwed onto a blind hole 62*a* of the workpiece 62, the drive bit 40 needs to be screwed for a such depth that the screw head 61*a* reaches a bottom side of the blind hole 62*a*, such that the drive bit 40 needs to protrude for a length matching the depth of the blind hole 62*a*. When the screw 61 is screwed down to the bottom side of the blind hole 62*a*, i.e. the screw head 61*a* is stopped against the bottom side of the blind hole 62*a*, the lip portion 30*a* of the adjustment sleeve 30 is right stopped against the surface of the workpiece 62 to stop the drive bit 40 from moving further and to stop the user from applying any positive force to the drive bit 40. In the meantime, the clutch 52 stops the transmission coupling to stop the drive bit 40 from rotation to avoid damage to the workpiece 62 or the screw 61.

In conclusion, the coupling member 10 mounted to the power tool 50 is engaged with the stationary sleeve 20 in such a way that the present invention can be quickly installed or detached from the power tool 50 without assistance of any tool.

Although the present invention has been described with respect to a specific preferred embodiment thereof, it is no way limited to the details of the illustrated structures but changes and modifications may be made within the scope of the appended claims.

What is claimed is:

1. A depth adjustment device mounted to a front end of a power tool, said power tool having a drive bit mounted to the front end thereof, said drive bit being driven by said power tool via a clutch, said drive bit being adapted for screwing a screw onto a workpiece, said depth adjustment device comprising:

a coupling member having a through hole and being fixed to the front end of said power tool so as to have said drive bit pass through said through hole, said coupling member having a limit recess and a lock recess at each of two opposite positions of an external periphery of said coupling member, and each said limit recess extending along an imaginary longitudinal axis of said coupling member, each said lock recess extending from said limit recess at the same position of the external peripher of said coupling member and extending along the external periphery of said coupling member and communicating with said limit recess;

a hollow stationary sleeve sleeved onto said coupling member for said drive bit to pass therethrough, said stationary sleeve having:

two first lock portions, each of which is formed at one of two opposite positions of an underside thereof and close to a rear opening thereof, said two first lock portions being respectively stopped against sidewalls of said lock recesses of said coupling member to stop said stationary sleeve from rotation with respect to said coupling member, said stationary sleeve having two spring parts formed at a rear end thereof, each of said spring parts having a second lock portion formed at a distal end thereof, said second lock portions being respectively locked to said lock recesses to prevent said stationary sleeve from disengaging from said coupling member, and said stationary sleeve having an external thread formed at an external periphery thereof; and a hollow adjustment sleeve sleeved onto said stationary sleeve, said adjustment sleeve having:

a lip portion formed at a front end of the adjustment sleeve for lying against said workpiece so as to have said drive bit pass through said adjustment sleeve and protruding beyond said lip portion, and said adjustment sleeve having an internal thread formed therein and engaged with said external thread of said stationary sleeve in such a way that said adjustment sleeve is capable of being movably mounted to said stationary sleeve, whereby a depth for which said screw is screwed onto said workpiece is capable of being adjusted when a length for which said drive bit protrudes beyond said lip portion is changed.

2. The depth adjustment device as defined in claim 1, wherein said stationary sleeve comprises a plurality of protrusive positioning clink pieces formed at an external periphery thereof; said adjustment sleeve comprises a plurality of positioning dents arranged parallel at an internal side thereof, each of said positioning clink pieces being stopped against one of said positioning dents.

* * * * *